United States Patent [19]

Jäger et al.

[11] 4,077,763

[45] Mar. 7, 1978

[54] METHOD FOR REGULATING COMBUSTION PROCESSES, PARTICULARLY FOR THE PRODUCTION OF CEMENT IN A ROTARY KILN

[75] Inventors: Gernot Jäger, Cologne; Hubert Wildpaner, Bensberg-Refrath; Horst Herchenbach, Troisdorf; Heinrich Rake, Aachen; Lutz Pütter, Raunheim; Heinrich Lepers, Roetgen-Rott, all of Germany

[73] Assignee: Klöckner-Humboldt-Deutz Aktiengesellschaft, Germany

[21] Appl. No.: 660,863

[22] Filed: Feb. 24, 1976

[30] Foreign Application Priority Data

Feb. 24, 1975 Germany ..... 2507840

[51] Int. Cl.[2] ..... F27B 15/00; F27B 7/02

[52] U.S. Cl. ..... 432/14; 432/18; 432/36; 432/106

[58] Field of Search ..... 432/18, 19, 36, 37, 432/54, 106, 58, 14

[56] References Cited

U.S. PATENT DOCUMENTS

| | | | |
|---|---|---|---|
| 3,437,325 | 4/1969 | Putnam et al. | 432/37 |
| 3,566,091 | 2/1971 | Bay | 432/37 |
| 3,578,298 | 5/1971 | Hurlbut et al. | 432/37 |
| 3,578,299 | 5/1971 | Hurlbut | 432/37 |
| 3,584,850 | 6/1971 | Brandvold et al. | 432/106 |

*Primary Examiner*—John J. Camby

*Attorney, Agent, or Firm*—Hill, Gross, Simpson, Van Santen, Steadman, Chiara & Simpson

[57] ABSTRACT

Techniques for regulating calcining processes, particularly the calcining of lime containing materials, which are supplied as pulverized raw material, into cement clinkers in a cylindrical rotary koln, provides that the exhaust gas preheats the raw material and the calcined material preheats the combustion air. The quantity of raw material and the quantity of combustible material, the temperature of the combustion air and of the exhaust gas, as well as the composition of the exhaust gas, and additional parameters of the process are continuously measured and partially controlled. From the continuously measured individual values of the process a characteristic value describing the condition of the process, particularly the supply of heat, is formed, and is utilized to regulate the calcining process.

45 Claims, 2 Drawing Figures

METHOD FOR REGULATING COMBUSTION PROCESSES, PARTICULARLY FOR THE PRODUCTION OF CEMENT IN A ROTARY KILN

BACKGROUND OF THE INVENTION

1. Field of the Invention

This invention relates to a method of regulating combustion processes, particularly for the combustion of lime-containing minerals, which are present as pulverized raw material, into cement clinkers in a rotary kiln by means of a combustion material during the supply of air or oxygen, whereby the exhaust gas preheats the pulverized raw material and the burned material in the combustion air, and in which the added raw material and quantity of fuel, the temperature of combustion air and of the exhaust gas, as well as the exhaust gas composition and other process parameters are continually measured and at least partially controlled.

2. Description of the Prior Art

In the production of cement it is known, for example from the German Laid Open Specification No. 2,224,049, to control a combustion process through the use of regulators or a process calculator of the regulating operations with the aid of favorably appearing values of the combustion process, such as the rotary speed of the kiln, the quantity of fuel and the material temperature in the kiln. In this connection, however, the influence of other parameters not considered, so that the combustion process control is only partially complete. Fluctuations in quantity and an insufficient utilization of fuel are, among other things, the result.

In the control of melting processes, particularly in the process control of blast furnaces, it is known, for example, from the "Journees Internationales de Sidbrurgie 1970", (International Stages of Metallurgy, 1970) with the aid of the total calculation of heat utilization which is regarded as characteristic of the process, to control the melting operation. However, such a regulation has the prerequisite that an isothermic zone be present in the central area of the kiln or furnace, and in addition, that the process proceeds almost statistically, as in the blast furnace process. Only then is the total heat utilization adaptable as a characteristic value for a process regulation. For more rapidly traveling or proceeding combustion process, particularly in rotary kilns, in which, in contrast to the static behavior of a blast furnace, the operations progress on a dynamic basis, the entire heat utilization cannot be employed as a characterizing feature and a characterizing regulation according to the previous state of the art is not possible.

SUMMARY OF THE INVENTION

The object of the present invention is to provide a comprehensive regulating system for combustion processes, which decreases, in particular, the total utilization of heat of the combustion process and improves the quality of the burned articles or products.

The above object is achieved, according to the invention in that from the continually measured individual values of the combustion process, a characteristic value describing the condition of the process, particularly the heat supply, is formed and the combustion process is regulated with the aid of this characteristic value. In this manner, it is advantageously attained that a regulation is available which permits of a direct reference to the total heat utilization of the installation, without, however, being beset with the errors and inaccuracies as well as the burden of a regulation after the total heat use.

In one embodiment of the invention, it is provided that the exergy, that is the technical operating capacity of the combustion gases for the combustion process, is selected as the characteristic value. Through the selection of this characteristic value, it is taken into consideration that the sintering process is the more intensive, the more heat is made available therefore and the higher is the temperature level at which the heat is made available. Through the selection of the exergy as the characteristic value for the process, it is accordingly possible to attain an optimization of the quality and of the total heat utilization of the combustion process.

In another embodiment of the invention, it is provided that the technical operating capacity of the combustion gas for the combustion process, the exergy, is held constant at a predetermined theoretical value. Thus, it is advantageously attained that with the aid of the characterizing value a normal actual-theoretical value regulation of the combustion process may be introduced and the regulation of the combustion process may take place according to normal regulating principles.

In a further embodiment of the invention it is provided, that through alterations in the theoretical value of the technical operating capacity, referred to the output, of the combustion gases (exergy index), the combustion process is carried out. Through the introduction of the exergy index, it is advantageously provided that an index, referred to the quantity of combustion material, is made available, which at all times provides information as to the state of the combustion process.

In further embodiments of the invention, it is provided that with changes in output, the maintaining the exergy index constant provides as low as possible total heat utilization of the combustion process and that changes in the qualities of the burnt materials are provided by means of exergy changes. Through these references it is advantageously attained that the total heat utilization of the combustion process influenced directly through the exergy index, that is, through the technical operating capacity, referred to the output, of the combustion gases, and that the characteristics of the burnt materials may be controlled by means of theoretical changes in the exergy, so that an actual control of the combustion process is possible with the aid of the exergy.

In one embodiment of the method, it is provided, that the measured process parameter values of the combustion process are prepared and a device is introduced for the formation of a characteristic value, which provides the control of the combustion process through an influencing of the characteristic value. Advantageously, in this manner a regulating device is available in which the characteristic value which describes the parameter values of the process serves as an actual value of a regulator and thus, with the actual value-theoretical value regulation normally used with regulators, permits control of the combustion process. In this connection, the device for the formation of the characterizing value is advantageously to be constructed as a process regulator or a calculator with program control; however, the device may also be constructed as an analog or comparator, summator, divider, multiplier, etc, operating in another manner. The process calculator may selectively be provided with a fixed index card system or with a variable program embodiment.

In order to introduce into the device for the formation of a characteristic value, and accordingly of the regulating device, in any case, the values correctly describing the condition of the process and thereby prevent errors in conducting the process, the measured amounts before their feed into the system for the determination of the characteristic value or for regulation are subjected to a plausibility control in which unbelievable measured values are separated out and replaced by previous or by interpolated measuring values from other equivalent measuring values which have a similar information content. This may likewise selectively occur by means of a process calculator or by means of classic regulators which, upon exceeding a predetermined limit, switch off or disconnect the forwarding of the measured values, or revert in condition back to other values.

In one embodiment of the regulating method, it is provided that characteristic amounts of the different quantities of heat, of the temperature level of the process, and the material flow be introduced into a device for the formation of the characteristic value. For this purpose, advantageously, the essential partial quantities of heat characterizing the combustion process, as well as the measured values characterizing the exergy, are detected and the device is made available for the formation of the characteristic value. Through the advantageous type of regulation according to the invention, it is possible, through changes in the theoretical value of the exergy, to directly influence the free residual lime content of the clinker and, in particular, to provide that with corresponding accurate control of the exergy index, just as accurate of a control of the free lime content is possible, and, accordingly, a good product quality which was previously not attainable with accurately defined free lime content of the clinker.

In a further embodiment of the invention it is provided that the analyzing device has an adaptation system in which the measured free lime content is converted to the free lime content produced in the sintering zone at the time of measuring. Advantageously, the dead periods between clinker formation and determination of the free lime content from the clinker are taken into consideration. Beyond this, the deviation of the free residual lime content may be combined with the deviation present at the point of time of the occurrence of the clinker test, of the actual value of the characteristic value from its theoretical value. If then a reference to the theoretical value of the characteristic value produced and the influencing in the deviation of the theoretical value and actual value correspondingly is taken into consideration, there results a complete consideration of the condition of the clinker formation with the technically regulating accurate value of the free lime content during the clinker formation and its combination with the exergy index.

In an embodiment of the method, it is provided, that the set amounts for the fuel and pulverized raw material flow are compared with their actual values, and the particular difference takes effect through a regulating algorithm on the heat exchange air current. Advantageously, likewise the deviation of the coefficient of excess air in the inlet chamber from its theoretical value is taken into consideration.

The tendency of the temperature profile of the entire process and/or the furnace or kiln drive output advantageously changes the theoretical value of the characteristic value. With a negative tendency of the temperature profile of the entire process and/or the furnace or kiln drive output, the theoretical value, for example, is increased.

In another embodiment of the invention, it is provided that for appreciable changes in the quantity of charge, the theoretical value of the characteristic value and the theoretical value of the fuel setting amounts are brought, according to predetermined curves, to selected values. Through this measure, it is advantageously possible, upon disturbances or other special conditions of operation, to bring about with the aid of the regulation of the characteristic value, a new point of operation corresponding with the disturbances or other special conditions of operation, and to apply thereat further the regulation of the characteristic value with its advantageous effects to the total heat consumption and quality.

The measured process parameters are constantly supplied to a device for testing the adaptability to the regulation of exergy. Hereby is made possible a constant decision, normal regulation with characteristic value or disturbance regulation, which with too great deviations may bring about an automatic connection of the disturbance regulating equipment.

In a further embodiment of the method, it is provided that with too great deviations of the measured parameters, either a disturbance regulation device is taken into operation, which normalizes the process by means of the contacts or engagements independently of the regulation of the characteristic value, or that this system is converted to manual operation. In this manner, it is advantageously possible to correspond with conditions of operation, as such conditions may occur also with the exergy regulation, be it through external influences, be it through mechanical damage parts or the devices participating in the process, and to adapt an arranged regulation which is in keeping with these special conditions of operation, and in particular to control equally with too great deviations of the sinter zone temperature, under consideration of the speed of the deviations and the direction of the deviations, for example, the rate of rotation of the furnace or kiln and/or the flow or stream of pulverized raw material.

The individual quantities of heat may be determined through the losses in radiation, the clinker heat, the losses in exhaust gas, the theoretical heat of clinker formation and the quantity of heat again recovered from the cooler. With this distribution, advantageously the individual quantities of heat are determined, which are necessary for carrying out the process, without unimportant partial quantities of heat not essentially influencing the entire process being taken into consideration, which quantities necessarily burden the conduct of the process.

The radiation losses are advantageously determined by measuring the furnace or kiln wall temperatures in different furnace or kiln zones, and the clinker waste heat is formed from measuring the clinker temperature, the clinker stream or flow and the specific heat content of the clinker. The quantity of heat of the exhaust gases is determined through the temperature of the exhaust gas, the quantity of exhaust gas and the specific heat content of the exhaust gas, whereby the quantity of exhaust gas is determined in a known manner in the cement industry from the stream of raw material and its composition, the stream of fuel and its composition, the analysis of the flue gas and partially from the quantity of air supplied with the fuel. Thereby, the particular specific heat content is formed by the temperature, in each case, in connection with the heat content curves, whereby the heat content curves may be present selectively numerically as charging values for the process computer or as an actual curves in regulating devices. Likewise, the devices for the formation of the quantities of heat are conceivable as parts of a process computer which are connected with one another and with the device for forming the characteristic value, or as individual regulators which by means of the analog or other embodiment of computer operations with predetermined characteristics form the individual values for the formation of the characteristic value.

The theoretical clinker formation heat is determined from the analysis of the pulverized raw material and the clinker stream and the quantity of heat recovered from the fuel—out of the fuel analysis and the fuel stream. The quantity of heat recovered from the cooler is formed from the quantity of air passing out of the stream of fuel and its composition, and from the exhaust gas analysis at the material entry point of the furnace (inlet chamber). The temperature level of the process is formed from the difference of the clinker formation temperature and the temperature of the flue gas upon combustion. This difference determines the utilization of the temperature level of the proffered heat; it is accordingly essential for the conduct of the combustion process. The utilization of the temperature level is especially advantageous, as from this the utilization of the combustion process substantially results. At too high temperatures, the heat losses rise, at too low temperatures, the combustion effect is insufficient.

The temperature of the flue gas is determined from the air content and the enthalpy of the flue gas with the aid of predetermined curves. The determination with the aid of predetermined curves, as already stated above, is possible through a process computer installation or by means of normal regulators. The magnitude of the material flow is formed by means of the quantity of pulverized raw material charging the furnace, the migration velocity and distribution of the pulverized raw material and a clinkering factor. The velocity of migration and the distribution of pulverized raw material is determined in dependence upon the rate of rotation of the furnace and the speed of gas in the furnace with the aid of predetermined curves. The determined magnitude of the material stream is advantageously correct by means of condition values of the cooler.

Furthermore, advantageously the clinkering factor is continuously formed from the ratio of the charged quantity of pulverized raw material and the quantity of clinker. For this purpose, a further control characteristic value is made available.

In a further embodiment of the invention, it is provided that a regulating device converts the deviation of the exergy from its theoretical value into setting signals for the fuel and/or pulverized raw material flow. Advantageously, with the aid of characteristic value in theoretical deviation according to need, the more favorable adjusting of fuel and/or pulverized raw material is made possible. The regulation with the aid of the flow of fuel thereby has the advantage that of the simplicity and speed, at the same time, the flow of the pulverized raw material is still regulated. In the case of an excess of air upon the combustion attains too greatly deviating values, or on account of attainment of the maximum quantity of combustion air, a further increase in the quantity of fuel is no longer available, the control of the raw pulverized material occurs in an amplified manner, in order to make possible a constant control of exergy with its favorable return effect on the total use of heat, also in these borderline cases. The regulation of the flow of fuel thereupon occurs with the aid of a theoretical-actual value regulation and, advantageously, the theoretical value of fuel flow is altered in dependence upon the variation in the amount of excess air.

The upper limit of the setting signals in one embodiment of the invention is advantageously determined by a limiting mechanism. The upper limit is thereby continuously determined by the quantity of flow of fuel, by the amount of excess air determined from the gas analysis and a predetermined minimum amount of excess air. The lower limit of the setting values is determined alternatively by:

(1) through the flow of fuel and the minimum fuel flow, as well as through the temperature of clinker output and the temperature of minimum clinker output;
(2) through the flow of fuel and the gas temperature at the material inlet side in the furnace; and
(3) through the pre-deacidification in the heat exchanger and the flow of fuel.

With the above it is advantageously prevented that areas are reached through the regulation in which the conduct of the process is no longer to the point, or permissible. The predeacidification is thereupon determined from the $CO_2$ content in the inlet chamber, the rate of excess air in the inlet chamber, the rate of excess air in the inlet chamber, the stream of raw pulverized material infeed, the stream of fuel and the fuel analysis, and thus is advantageously continuously available from the process magnitudes measured in any case.

In a further embodiment of the invention it is provided that upon an operation of the limiting mechanism for the setting values of the fuel stream, the parameters of the regulating algorithm supplying the setting magnitudes of the raw pulverized material are altered. Advantageous alterations in the regulating behavior are hereby possible, through which alterations a favorable conduct of the process is insured, even with limited setting magnitudes of the flow of fuel.

In a further embodiment of a method, it is provided that the deviation of the free residual lime content of the clinker from its predetermined theoretical value is altered by means of a regulating algorithm in the theoretical value of the characteristic value. Advantageously, even over long periods of time, the reference between the quality of combustion process, that is, the quality of the burned products and the conduct of the process, is hereby produced by means of the characteristic value.

BRIEF DESCRIPTION OF THE DRAWINGS

Other objects, features and advantages of the invention, its organization, construction and operation will be best understood from the following detailed description taken in conjunction with the accompanying drawings, on which.

DESCRIPTION OF THE PREFERRED EMBODIMENTS

Figure 1:
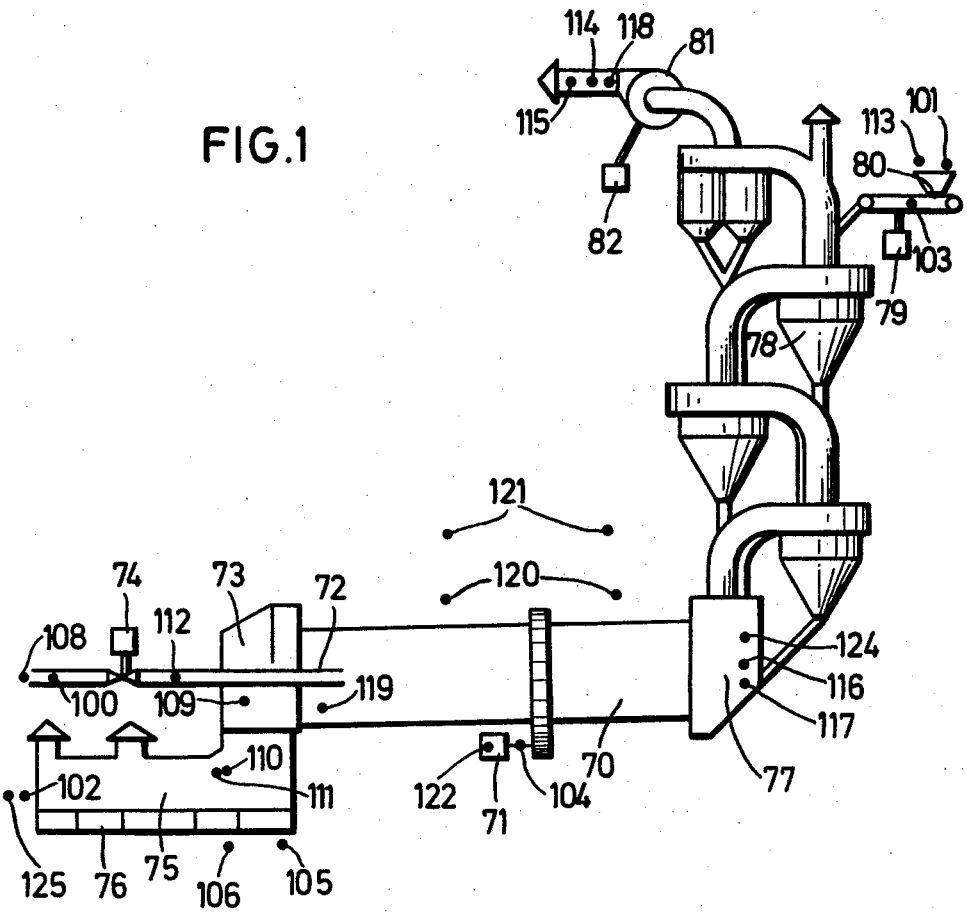
FIG. 1 illustrates a cylindrical rotary kiln, grate cooler, cyclone heat exchanger system for cement which may utilize the method of the present invention.

In FIG. 1 there is arranged in the material moving direction, in front of a cylindrical rotary kiln 70, a heat exchanger which is supplied with raw material at a raw material dosing installation 80. The installation 80 is driven by means of a regulatable drive 79. The combustion air passing through the cyclone heat exchanger 78 and against the combustion material so introduced, is drawn through the heat exchanger 81 having a regulatable drive 82, which is constructed as an induced draft blower. An inlet chamber 77 is located between the heat exchanger 78 and the cylindrical rotary kiln 70. The drive of the cylindrical rotary kiln 70 takes place by means of a regulatable motor 71. On the material outlet end of the cylindrical rotary kiln, is located a burner jet 72 which projects through the outlet chamber 73 into the cylindrical rotary kiln 70. The burner is provided with a regulator 74 for regulating the quantity of fuel delivered to the burner. A grate cooler 75 includes, in its lower portion, a regulatable driven grate 76.

The distribution of the measuring points important for the regulation of the system in accordance with the invention, for which additional measuring devices serving for supervision and ensuring the combustion process is as follows:

On the air inlet side of the clinker cooler, the grate cooler may also be replaced by means of a satellite cooler or some other cooler, the shear number or linear strain of the cooler grate and the pressure beneath the grate is measured by means of respective measuring devices 105 and 106. At the cooler outlet, the stream of clinker is measured at the measuring point 102 and the free lime content of the clinker is measured at the point 125. In the grate cooler are located the measuring points 110 and 111, and in the outlet chamber the measuring point 109, with which the average value of the outlet temperature is measured. The measuring point 108 serves for the fuel analysis and the measuring point 100 for measuring the primary air stream which is added to the fuel for combustion. The fuel stream is measured in the burner at the measuring point 112. The measuring point 119 serves for measuring the clinker temperature at the furnace outlet. At the measuring point 104, the speed of rotation of the cylindrical rotary kiln 70 is measured and at the measuring point 120, the furnace sleeve temperature is sensed. The measuring point 121 provides the position of the point on the furnace sleeve measured in each case.

The measuring points 124, 116 and 117 are located in the inlet chamber 77. The measuring point 124 measures the temperature of the inlet chamber, and the measuring points 116 and 117 provide a measurement of discontinuous or continuous gas analysis.

The next measuring point relevant for the process is located at the charging station of the raw pulverized material, where the stream of pulverized raw material is measured with the aid of the conveyor type weigher at the measuring point 103. The point 101 designates a measure of the $CO_2$ content of the pulverized raw material, and this value is likewise taken from the pulverized raw material analysis carried out in front of the conveyor type weigher at the measuring point 113. The measuring points 118, 114 and 115 are located behind the heat exchanger. The exhaust gas temperature is determined at the measuring point 118, while the $O_2$ and the CO content of the exhaust gases is determined at the measuring points 114 and 115, respectively. Together with the measuring points 116 and 117, the continuous exhaust gas analysis takes place through these measuring points. An oil flow regulator 74, a pulverized raw material regulator 79, a speed of rotation regulator of the heat exchanger blower 82, as well as a regulator 71 for the speed of rotation of the cylindrical rotary kiln 70 are provided as adjustable regulating devices.

Well known measuring instruments are located at the measuring points, which instruments operate according to the generally known measuring methods; thus, thermo-elements for gas temperature measuring, pyrometers for radiation measurements, static tubes or pressure heads for pressure measurements, measuring orifices or restrictors,—or counters, respectively, for the measuring of quantities and tachometers for speeds of rotation, as well as analysis devices for the corresponding analyses, which operate continuously or discontinuously, are provided, such devices being well known to those skilled in the regulating art. The different analyses may also be carried out by hand.

Figure 2:
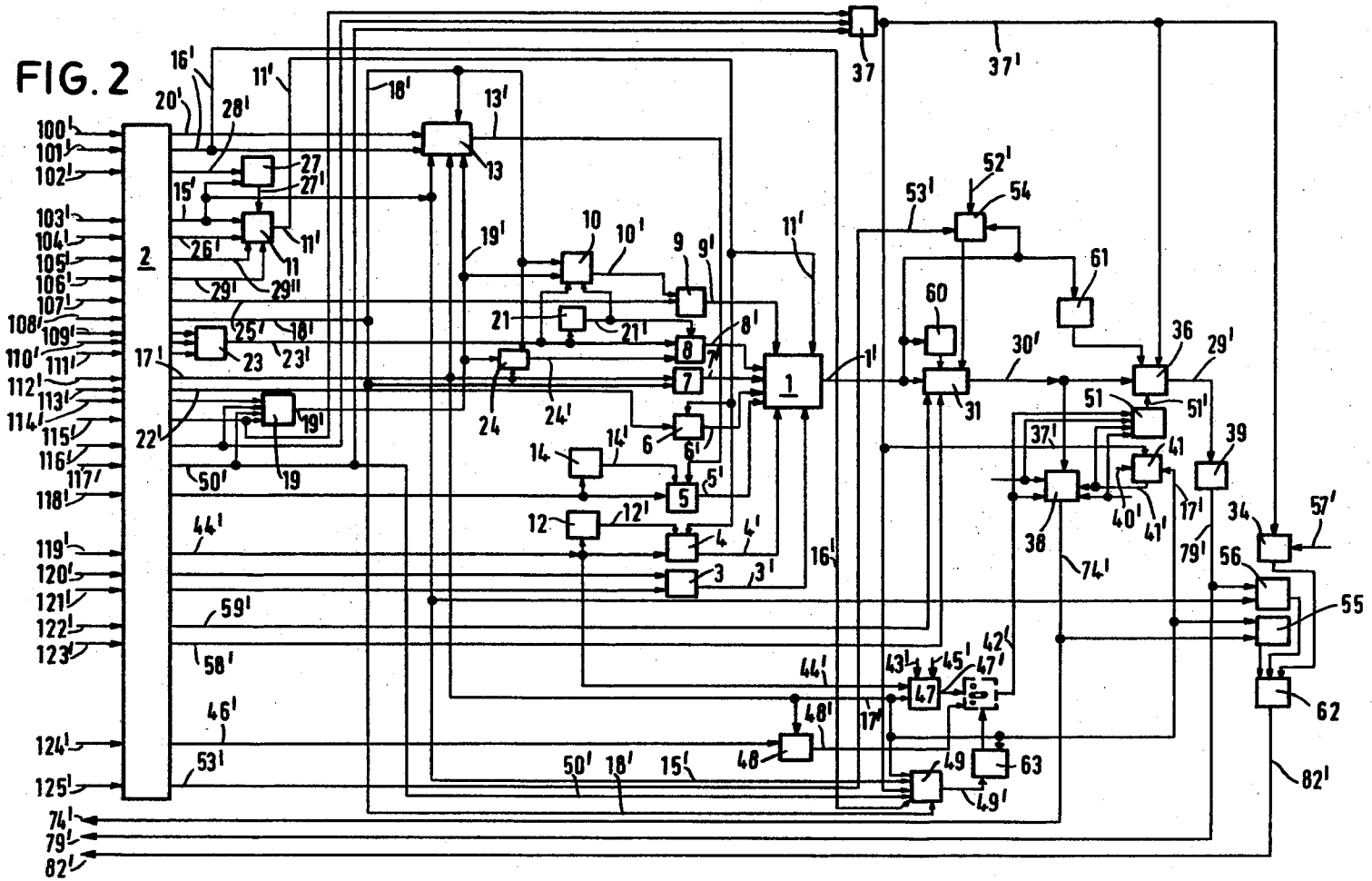
FIG. 2 illustrates the method and connection arrangement of a device for determining a characteristic value and a regulating device, illustrated diagrammatically.

Referring to FIG. 2, the operation of the method and the arrangement of the individual elements for carrying out the method are illustrated and will become readily apparent from the description below.

The measured value supplied from the measuring points 100 to 125 which produce directly measured values, with the exception of the values 123 and 107 which indicate predetermined values, are first fed to the portion of the regulating device which carries out a plausibility control of the measured values. Here, first the plausibility is tested, and when a value—either through too rapid alteration or through an exceeding of limits of the device 2—appears as not plausible, this value is separated out. The separated out measured values are replaced through previous measured values or, if no previous measured values are present, or the latter likewise are not believable, the separated values are replaced through measured values of other measuring points which have a similar information content. Therefore, approximately the $O_2$ and $CO_2$ measurement at the inlet chamber 77, upon elimination of the analysis device installed there which may be operating discontinuously (for example, a wet removal sampling device with automatic analysis device connected in series), is replaced by the values of $O_2$ and $CO_2$ portions calculated through the $O_2$ and the $CO_2$ portions in the exhaust gas behind the heat exchanger.

The partially corrected values taken from the switching part for the plausibility control are supplied through the intermediary devices for formation of further regulating values to the device 1 for the formation of the regulating characteristic value. The latter delivers the actual value of the condition of the process for the regulating device connected in series therewith.

The individual characteristic values 3', 4', 5', 6', 7' and 8' of the individual heat quantities, the characteristic value 9' of the temperature level of the process and the characteristic value 11' of the material stream are fed to the device 1 for the formation of the regulating characteristic value.

The size of the radiation losses is determined by means of the measurement of the furnace wall temperature at different furnace zones, and as an example with the aid of the setting of the furnace sleeve pyrometer and the furnace sleeve temperature in the characteristic value device 3.

The device 4 for the determination of the characteristic value of the clinker waste heat 4' determines the clinker waste heat 4' from the measurement of the clinker temperature measuring value 44', the clinker stream 11' and the specific heat content of the clinker 12'.

The quantity of heat of the exhaust gas 5' results from the quantity of exhaust gas 13' and the specific heat content of the exhaust gas 14'. The specific heat content of the exhaust gas 14' is thereupon determined with the aid of the device 14 from the exhaust gas temperature 118' with the aid of predetermined curves. The quantity of exhaust gas 13' in the device for the determination of the quantity of the exhaust gas 13, which, for example, operates according to the known VDZ method (published in the VDZ special print No. 7) is determined from the quantity of raw material 15' from the raw material composition 16', from the size of the stream of fuel 17' and its composition 18', the flue gas analysis 19' and the quantity of air (primary air quantity 20') conveyed with the fuel. The values of the particular specific heat content 12' and 14' are formed in the devices 12 and 14 through the particular temperature (exhaust gas or clinker temperature) in connection with heat content curves. In this connection, the devices 12 and 14 contain the heat content curves selectively in digital form as functions or curves.

The value of the theoretical clinker formation heat 6' is determined in the device 6 from the analysis of raw pulverized material and the clinker stream 11'. The quantity of heat 7' recovered from the fuel is formed in the device 7 from the fuel analysis 18' and the stream of fuel 17'. As a last heat quantity which is essential for the conduct of the process, the quantity of heat 8' recovered from the cooler is formed from the quantity of air 24' passing from the cooler into the furnace, which is determined in the device 24, the temperature of this quantity of air 23', which shows an average value of the temperatures from the temperature measuring points 109, 110 and 111 and from the specific heat 21' which is determined in the device 21. In this connection, the quantity of air 24' passing into the device 24 is formed from the fuel stream 17' and its composition 18' and from the exhaust gas analysis 19' at the material inlet point.

The temperature level 9' of the process is formed in the device 9 from the difference of the clinker formation temperature 25' and the flue gas temperature 10'. The flue gas temperature 10' is determined from the air content and the enthalpy of the flue gas with the aid of the predetermined curves in the device 10.

The magnitude of the material stream 11' is formed by the quantity of charge of pulverized raw material 15', the migration speed 26' and a clinkering factor 27'. For this purpose, the device 11 is provided to which additional magnitudes 29' and 29'' are provided as correction factors of the cooler. The clinkering factor 27' is continuously provided from the proportion of quantity of pulverized raw material 15' charged to the system and the quantity of clinker 28' formed and supplied to the device 11. The final magnitudes 3' to 9' determined by means of the cooperation of the regulating devices for the formation of the characteristic values, etc, are supplied to the device 1 for the formation of the characteristic value and are there processed to the characteristic value 1'.

FIG. 2 is, in this respect, to be regarded as an advantageous arrangement of these individual devices and apparatus, which are joined together in the switching and control form illustrated. FIG. 2 may, however, also be regarded as a functional diagram of an integrated regulating installation in which the individual devices represent functional blocks of a process computing installation, which blocks are combined with one another in the manner illustrated.

The magnitude of the characteristic value 1', formed for the determination of the characteristic value, acts on the regulating device 31, which forms the actual value-theoretical value comparison, setting signals for the stream of fuel 30'. Therefore, the stream of fuel 30' is adjusted preeminently by means of the regulating algorithm 31. Furthermore, the fuel setting value 30' is compared with a predetermined theoretical value and converted through a second regulating algorithm 36 into a setting magnitude for the quantity of pulverized raw material. The amount of excess air 37' takes effect on the device for the adjustment of the theoretical value of the fuel stream, which is determined in the device 37 from the individual values of the fuel analysis of the quantity of combustion air. The setting signals for the magnitude of the fuel and pulverized raw material streams are, by a limiting mechanism in the devices 38 and 39, subjected to a control which limits their magnitude. The size of the limitation 41' is, in this connection, continuously determined anew from the quantity of fuel flow 17', from the excess air amount 37' and an amount of minimum excess air 40', whereby the amount of minimum excess air is fixedly predetermined as a theoretical value. The lower limit of the setting value of fuel flow 42 is, in this connection, determined separately. This occurs alternatively, and by:

1) in dependence upon the pre-deacidifying 49', which is determined from the $CO_2$ content in the inlet chamber 50', the amount of excess air 37', the distribution quantity of pulverized raw material 15', the stream of fuel 17' and the fuel analysis 18';
(2) in dependence upon the temperature 46' of the inlet chamber, and the fuel stream 17'; and
b 3) the fuel stream 17', the stream 43' of minimum fuel, the temperature 44' of the clinker output and the temperature 45' of minimum output.

A reaction is effected upon starting of the limiting mechanism 38 for the setting magnitude of the fuel stream 30' to form the characteristic value 51' in the device 51 and to influence the regulating algorithm 36.

In the regulating algorithm 31 the theoretical value of the characteristic value is compared with the actual value 1', whereby the theoretical value of the characteristic value is formed by the device 54. This takes place from the free content of the residual line of the clinker 53' from its predetermined theoretical value 52'. Additionally, the magnitude of the characteristic value is imparted to the device 54. The devices 60 and 61 serve this purpose in that, for appreciable changes in the quantity of output, the theoretical value of the characteristic value and the theoretical value of the setting magnitude of the fuel stream are brought to selected values, according to predetermined curves.

In addition to the normal fuel and raw material stream regulation, the heat exchanger air stream 33' is regulated, whereby deviations in the amount of excess air 37', by their theoretical value 37', act on the heat exchanger stream 33' through the regulating algorithm 34. For a technical applicability, further regulating steps are provided which may be recognized in detail from the combination of the regulating devices. Therefore, for example, with a negative tendency of the temperature profile 58' and/or the furnace driving output 59', the theoretical value of the characteristic value is increased.

Furthermore, the measured process magnitudes of a device for the testing of its applicability are supplied to the exergy regulation. In circumstances where there is great deviations of the process magnitudes, either a control device is taken into operation to normalize the process through engagements independent of the characteristic value regulation or a conversion to manual operation is possible, without this being particularly illustrated on the functional diagram.

Furthermore, it is provided, that with too great deviations in the sintering zone temperature, the control device acts according to the temperature gradients and/or the gradients of the power required on the quantity of pulverized raw material and/or dependent on time, on the speed of rotation of the furnace, without the same being shown separately in the functional diagram.

The devices for determining the characteristic magnitudes or the characterizing value, respectively, are provided with time correction devices, not shown separately, which bring about the timewise correct correlation of the individual magnitudes with one another, particularly upon the determination of the characteristic value.

Likewise, as in the switching arrangement for the determination of the characteristic value, also the arrangement for the regulation of the air of this characteristic value is realized from individual regulators and regulating algorithms, which are combined with one another in the manner illustrated. It is, however, advantageously likewise possible to conceive of the regulating devices shown as functional blocks of an integrated regulating device, which is not constructed as a process computer; for example, a card index system may be utilized without the same impairing regulating methods according to the invention and their embodiment, and without impairing portions of the invention.

The described regulating device and the described regulating method are particularly adapted to the calcining of cement; however, the same is just as applicable to the calcining of lime, dolomite, and other calcining processes which are advantageously carried out in cylindrical rotating kilns.

Inasmuch as a number of detection points are provided in the system, the following schedule is provided for reference to such points and their detecting functions.

SCHEDULE OF MEASURING POINTS

| Point | Function Measured |
|---|---|
| 100' | Primary Air Stream |
| 101' | $CO_2$ Content-Pulverized Raw Material |
| 102' | Clinker Stream |
| 103' | Pulverized Raw Material Stream |
| 104' | Speed of Rotation of Kiln |
| 105' | Linear Strain |
| 106' | Cooler Chamber Pressure |
| *107' | Sintering Temperature |
| 108' | Fuel Elementary Analysis |
| 109' | Secondary Air Temperature |
| 110' | Secondary Air Temperature |
| 111' | Secondary Air Temperature |
| 112' | Fuel Flow |
| 113' | Analysis of Pulverized Raw Material |
| 114' | $CO_2$ Flue Gas Analysis - WT |
| 115' | CO Flue Gas Analysis - WT |
| 116' | $O_2$ Flue Gas Analysis - EK |
| 117' | $CO_2$ Flue Gas Analysis - EK |
| 118' | Exhaust Gas Temperature |
| 119' | Clinker Temperature |
| 120' | Furnace Sleeve Temperature |

-continued

SCHEDULE OF MEASURING POINTS

| Point | Function Measured |
|---|---|
| 121' | Furnace Sleeve Pyrometer Setting |
| 122' | Furnace Drive Output |
| *123' | Temperature Profile |
| 124' | Inlet Chamber Temperature |
| 125' | Clinker-Free Lime Content |

*Predetermined Value Settings

The following schedule of components is representative of structures which may be advantageously utilized in practicing the present invention.

| Reference No. | Functional Structure |
|---|---|
| 1 | Calculating Unit for Characteristic Value |
| 2 | Unit for Data Sampling and Basic Calculation (calibration,smoothing,error detecting,etc.) |
| 3 | Convection and Radiation Heat Loss Calculating Unit |
| 4 | System Heat Loss for Clinker Output Calculating Unit |
| 5 | System Heat Loss from Waste Gas Calculating Unit |
| 6 | Theoretical Heat Necessary for Clinker Formation Calculating Unit |
| 7 | Heat Obtained by Burning Gas and/or Calculating Unit |
| 8 | Heat Recuperation Calculating Unit for Heat Input from Clinker Cooling |
| 9 | Calculating Unit for Relative Niveau of the Process |
| 10 | Burning Zone Gas Temperature Calculating Unit |
| 11 | Unit for Calculating Material Flow through Burning Zone |
| 12 | Unit for Calculating Specific Heat Content of Output Clinker |
| 13 | Device for Calculating Gas Flow Leaving System |
| 14 | Unit for Calculating Specific Heat Content of Waste Gas |
| 19 | Gas Analysis Calculating Unit |
| 21 | Calculating Unit for Specific Heat Content of Output Clinker |
| 23 | Unit for Calculating the Arithmetic Mean Value of the Secondary Air Temperature |
| 24 | Secondary Air Flow Calculating Unit |
| 27 | Raw Meal/Clinker Factor Calculating Unit |
| 31,34,36 | Control Units |
| 37 | Calculating Unit for Excess Air Figure |
| 38,39 | Limiters |
| 41 | Upper Limit Calculating Unit |
| 47,48 | Lower Limit Calculating Units |
| 49 | Calculating Unit for Calcination Ratio |
| 51 | Control Parameter Calculation Unit |
| 54 | Set Point Computer for Characteristic Value |
| 55,56 | Control Units |
| 60 | Throughput Rise Calculating Unit |
| 61 | Throughput Diminuation Calculating Unit |
| 62 | Adder |
| 63 | Lower Limit Calculating Unit |

Each of the above structures are well known in the art and their interconnection and operation are readily apparent to those skilled in the art so that a detailed discussion thereof is not deemed necessary.

Although the invention has been described by reference to particular illustrative embodiments thereof, many changes and modifications of the invention may become apparent to those skilled in the art without departing from the spirit and scope of the invention. It is therefore intended to include within the patent warranted hereon all such changes and modifications as may reasonably and properly be included within the scope of this contribution to the art.

What is claimed is:

1. A method of calcining minerals particularly lime-containing minerals in the form of pulverized raw material, comprising the steps of:

feeding a combustible fuel-air mixture to a burner in a rotary kiln and exhausting gases from the kiln through a cyclone heat exchanger;

feeding the pulverized raw material to the kiln through the heat exchanger to preheat the raw material in the heat exchanger and calcine the raw material in the rotary kiln, the calcined material preheating the fuel-air mixture;

measuring and generating a signal representing, the temperature of the fuel-air mixture;

measuring and generating a signal representing the temperature of the exhaust gases;

measuring and generating a signal representing the quantity of added raw material, the quantity of added fuel;

measuring and generating a signal representing the gas composition of the exhaust gases;

forming a characteristic value signal from the generated signals to represent the exergy of the process; and regulating the calcining process with the aid of the characteristic value signal.

2. A method of regulating a calcining process, particularly the calcining of lime-containing minerals which are present as pulverized raw material, into cement clinkers in a cylindrical rotary kiln in which fuel is burned in the kiln to produce exhaust gases which preheat the pulverized material and in which the calcined material preheats the combustion air fed with the fuel, comprising the steps of:

measuring and generating a signal representing heat loss of the kiln;

measuring and generating a signal representing clinker waste heat;

measuring and generating a signal representing exhaust gas heat;

measuring and generating a signal representing clinker formation heat;

measuring and generating a signal representing heat recovered from the fuel;

measuring and generating a signal representing heat recovered from the cooler part of the kiln;

measuring the quantity of raw material being processed and generating a signal representing that quantity;

generating a characteristic value signal in response to the above-mentioned signals representing system exergy; and applying the characteristic value signal to apparatus for controlling the regulation of fuel feed, raw material feed and exhaust blower operation of the kiln.

3. A method of regulating a calcining process, according to claim 2, wherein the step of measuring and generating a signal representing heat loss of the kiln is defined as comprising the steps of:

measuring the sleeve temperature of the kiln;

measuring the furnace sleeve pyrometer setting; and generating the kiln heat loss signal in response to the kiln temperature and sleeve pyrometer setting.

4. A method of regulating a calcining process according to claim 2, wherein the step of measuring and generating a signal representing clinker waste heat is defined by the steps of:

measuring the clinker temperature;

measuring the clinker flow;

measuring the clinker specific heat content; and generating the clinker waste heat signal in response to clinker temperature, flow and specific heat content.

5. A method of regulating a calcining process according to claim 2, wherein the step of measuring and generating a signal representing exhaust gas heat is defined by the steps of:

measuring the exhaust gas temperature;

measuring the quantity of exhaust gas;

measuring the specific heat content of the exhaust gas by comparing the exhaust gas temperature with predetermined temperature-heat content curves; and generating the exhaust gas heat signal in response to the temperature, quantity and specific heat content of the exhaust gas.

6. A method of regulating a calcining process according to claim 2, wherein the step of measuring and generating a signal representing clinker formation heat is defined by the steps of:

analyzing the content of the raw material; and generating a theoretical clinker formation heat signal in response to material analysis and the measured flow of raw material.

7. A method of regulating a calcining process according to claim 2, wherein the step of measuring and generating a signal representing heat recovered from the fuel is defined by the steps of:

analyzing the fuel content;

measuring the fuel flow; and generating the signal representing heat recovered from the fuel in response to the fuel analysis and quantity of fuel delivered to the kiln.

8. A method of regulating a calcining process according to claim 2, wherein the step of measuring and generating a signal representing heat recovered from the cooler part of the kiln is defined by the steps of:

measuring the quantity of air passing from the cooler into the kiln;

measuring the temperature of the air flowing from the cooler into the kiln;

measuring the specific heat content of the air flowing from the cooler into the kiln; and generating the signal representing heat recovered from the cooler in response to the temperature, specific heat content and quantity of air flowing from the cooler into the kiln.

9. The method of regulating a calcining process according to claim 8, wherein the step of measuring the temperature of the air flowing from the cooler into the kiln is defined as:

measuring the average value of temperatures at spaced points of the air flowing from the cooler into the kiln; and applying the average temperature in the formation of the signal representing heat recovered from the cooler.

10. A method of regulating a calcining process according to claim 2 wherein the step of measuring the quantity of raw material being processed and generating a signal representing that quantity is defined by the steps of:

measuring the mass of raw material;

measuring the speed of rotation of the kiln;

measuring the linear strain on a cooler grate at the output of the kiln into the cooler;

measuring the air pressure in the cooler chamber;

measuring the clinker flow at the output of the cooler; and generating a raw material quantity signal in response to these measured parameters.

11. A method of regulating a calcining process according to claim 2, wherein the step of applying the characteristic value signal to apparatus for controlling regulation is further defined by the step of:

applying the characteristic value signal to apparatus which maintains the operating capacity of the combustion gases constant at a predetermined value.

12. A method of regulating a calcining process according to claim 11 comprising the step of:

adjusting the predetermined operating capacity value with respect to the operating capacity measured at the output.

13. A method of regulating a calcining process according to claim 11, comprising the step of changing the predetermined value of the operating capacity to control the characteristics of the calcined material.

14. A method of regulating a calcining process according to claim 2, wherein each step of measuring includes the step of sensing a parameter at a specific operating point in the system and generating a signal representative of that parameter, and further comprising the step of determining the plausibility of the correspondingly generated signal and substituting theoretical value signals for those signals which are determined not to be plausible.

15. A method of regulating a calcining process according to claim 14, wherein the step of substituting is further defined as replacing non-plausible signals with previously measured values.

16. A method of regulating a calcining process according to claim 14, wherein the step of substituting is defined as replacing signals found not to be plausible with signals generated at points in the system which have a similar information content.

17. A method of regulating a calcining process according to claim 2, wherein the step of measuring and generating a signal representing heat loss of the kiln is defined as comprising the steps of:

measuring the sleeve temperature of the furnace wall of the kiln at different zones of the kiln;

measuring a furnace sleeve pyrometer setting; and generating the kiln heat loss signal in response to the kiln temperatures in those zones and the sleeve pyrometer setting.

18. A method of regulating a calcining process according to claim 2, wherein the step of measuring and generating a signal representing clinker waste heat is defined by the steps of:

measuring the clinker temperature;

measuring the clinker flow;

measuring the clinker specific heat content by comparing the clinker temperature to heat content data; and generating the clinker waste heat signal in response to clinker temperature, clinker flow and clinker specific heat content.

19. A method of regulating a calcining process according to claim 2, comprising the steps of:

measuring the sintering temperature;

measuring the flue gas temperature upon combustion; and subtracting the sintering temperature from the combustion flue gas temperature to obtain the temperature level at which heat is made available to the process.

20. A method of regulating a calcining process according to claim 19, wherein the step of measuring the flue gas temperature upon combustion comprises the steps of:

detecting the air content of the flue gas;

comparing the air content of the flue gas with predetermined data to obtain the enthalpy of the flue gas.

21. A method of regulating a calcining process according to claim 2, wherein the step of measuring the quantity of raw material being processed and generating a signal representing that quantity comprises the steps of:

measuring the quantity of pulverized raw material being added to the system;

measuring the migration speed and distribution of the pulverized raw material through the kiln; and measuring a clinkering factor.

22. A method of regulating a calcining process according to claim 21, wherein the quantity of raw material being processed is adjusted by the step of:

measuring the linear strain of the cooler grate and the air pressure within the cooler and generating corresponding signals, and applying the corresponding signals to a unit which calculates the material flow through the burning zone of the kiln.

23. A method of regulating a calcined process according to claim 21, wherein the clinker factor is defined as and is formed by a proportion of the measured quantity of charged pulverized raw material flow and the measured clinker flow.

24. In a rotary furnace installation of the type which receives raw material and exhausts flue gases through a cyclone heat exchanger connected to an inlet chamber of the furnace and which has a regulatable fuel burning system, and which includes an outlet end feeding a regulatable drive type grate cooler, a regulating system for controlling the calcining process, comprising:

means for measuring and generating a signal representing heat loss of the furnace;

means for measuring and generating a signal representing clinker waste heat;

means for measuring and generating a signal representing exhaust gas heat;

means for measuring and generating a signal representing heat recovered from the fuel;

means for measuring and generating a signal representing heat recovered from the cooler;

means for measuring the quantity of raw material being processed in the furnace and generating a signal representing that quantity;

means for receiving the above-mentioned signals and in response thereto generating a characteristic value signal which indicates the exergy of the calcining process; and means for applying the characteristic value signal to the regulatable fuel feed to control the burning operation within the furnace.

25. A rotary furnace installation according to claim 24 comprising:

a blower for exhausting gas from the cyclone heat exchanger; and blower control means connected to receive the characteristic value signal for controlling blower operation and thus preheating of the raw material fed into the installation.

26. In a rotary furnace installation according to claim 24, comprising:

means for controlling the feeding of raw material into the installation in response to the characteristic value signal, thereby controlling the quantity of raw material being processed in the installation.

27. In a rotary furnace installation of the type which receives pulverized raw material and exhausts flue gases through a cyclone heat exchanger, via a blower, connected to an inlet chamber of the furnace through which the raw material is received, which has a fuel burning system including a fuel flow regulator, which includes an outlet end feeding a regulatable drive type grate cooler, and in which the furnace is rotated by a drive mechanism, a regulating system for controlling the calcining process, comprising:

first means for measuring and generating a signal representing heat loss of the furnace;

second means for measuring and generating a signal representing clinker waste heat;

third means for measuring and generating a signal representing exhaust gas heat;

fourth means for measuring and generating a signal representing heat recovered from the fuel;

fifth means for measuring and generating a signal representing heat recovered from the cooler;

sixth means for measuring the quantity of raw material being processed in the furnace and generating a signal representing that quantity;

seventh means responsive to the above-mentioned signals to generate a characteristic value signal indicative of the exergy of the calcining process; and regulating means responsive to the characteristic value signal to control the fuel regulator, the blower and the rotary drive mechanism of the furnace.

28. In a rotary furnace installation according to claim 27, wherein said regulating means comprises:

means for producing a fuel setting signal from the characteristic value signal; and means for comparing the fuel setting signal with a predetermined theoretical value and applying deviations therebetween to adjust the fuel setting.

29. In a rotary furnace installation according to claim 28, wherein said regulating means further comprises: a regulating algorithm device which is responsive to the fuel setting signal to produce a control signal for controlling raw material feed.

30. In a rotary furnace installation according to claim 28, comprising:

means for adjusting the predetermined value of the fuel setting including means for measuring and generating a signal representing the CO content of the exhaust gases, means for measuring and generating a signal representing the energy coefficient of the $O_2$ flowing from the furnace into the heat exchanger, means for measuring and generating a signal representing the energy coefficient of the $CO_2$ flowing from the furnace into the heat exchanger, and means for receiving the CO and the $O_2$ and $CO_2$ signals and generating an adjustment signal in response thereto.

31. In a rotary furnace installation according to claim 27, wherein said regulating means produces setting signals for the controlled elements, and comprising means for limiting the magnitude of such signals.

32. A method of regulating a calcining process in a rotary furnace installation which receive pulverized raw material and exhausts flue gases through a cyclone heat exchanger, via a blower, connected to an inlet chamber of the furnace through which the raw material is received, which has a fuel burning system including a fuel flow regulator, which includes an outlet end feeding a regulatable drive cooler, and in which the furnace is rotated by a drive mechanism, comprising the steps of:

measuring and generating a signal representing heat loss of the furnace;

measuring and generating a signal representing clinker waste heat;

measuring and generating a signal representing exhaust gas heat;

measuring and generating a signal representing heat recovered from the fuel;

measuring and generating a signal representing heat recovered from the cooler;

measuring and generating a signal representing the quantity of raw material being processed in the furnace;

combining the above-mentioned signals in accordance with predetermined heat content functions to provide a characteristic value signal representing system exergy for influencing the setting of the fuel regulator, the blower and the rotary drive mechanism of the furnace.

33. The method set forth in claim 32, comprising the steps of:

measuring the excess air upon combustion; and controlling the blower in accordance with the amount of excess air.

34. The method of regulating a calcining process according to claim 33 wherein the step of measuring the excess air comprises the steps of:

analyzing the gas flowing from the furnace into the heat exchanger;

analyzing the exhaust gas flowing out of the blower; and comparing the analyzed gas values to predetermined values to obtain a coefficient of excess air.

35. In a rotary furnace installation of the type which receives pulverized raw material and exhaust flue gases through a cyclone heat exchanger, via a blower, connected to an inlet chamber of the furnace through which the raw material is received, which has a fuel burning system including a fuel flow regulator, which includes an outlet end feeding a regulatable drive cooler, and in which the furnace is rotated by a drive mechanism and is fed raw material by a feed mechanism, a regulating system for controlling the calcining process, comprising:

means for measuring the air content of the fuel;

means for measuring the $CO_2$ content of the pulverized raw material;

means for measuring the clinker stream passing out of the cooler;

means for measuring the pulverized raw material being fed into the installation;

means for measuring the speed of rotation of the furnace;

means for measuring the linear strain of the material flow through the cooler;

means for measuring the pressure within the cooler;

means providing a set point representing the sintering temperature;

means for analyzing the fuel being fed;
means for measuring the average air temperature from the outlet of the furnace to the inlet of the cooler;
means for measuring the flow of fuel;
means for analyzing the raw material being fed;
means for determining the $O_2$ content of the flue gas;
means for determining the CO content of the flue gas;
means for determining the $O_2$ energy coefficient of the flue gas at the inlet of the furnace and outlet of the heat exchanger;
means for determining the $CO_2$ energy coefficient of the flue gas at the inlet of the furnace and the outlet of the heat exchanger;
means for determining the exhaust gas temperature;
means for determining the clinker temperature at the outlet of the furnace;
means for determining the sleeve temperature of the furnace;
means for determining the furnace drive power;
means providing a predetermined temperature profile through the furnace;
means for determing the clinker-free lime content at the outlet of the cooler,
each of the above parameter determinations and settings being constantly obtained; and
means responsive to the above parameters to generate a characteristic value signal which describes the exergy of the calcining process.

36. In a rotary furnace installation according to claim 35, comprising:
means connected to each of the parameter measuring means for receiving and determining the plausibility of the measured values.

37. In a rotary furnace installation according to claim 36, comprising means for substituting plausible values in response to receipt of nonplausible values.

38. In a rotary furnace installation according to claim 36, comprising:
means connected between said plausibility means and the plurality of parameter measuring means for forming characteristic values of the individual quantities of heat, temperature level of the process, material stream flow and fuel flow.

39. In a rotary furnace installation according to claim 35, wherein said means for measuring the clinker temperature comprises pyrometrically operating means.

40. In a rotary furnace installation according to claim 35, wherein said means for measuring the air and exhaust gas temperatures each comprise thermo-element measuring means.

41. In a rotary furnace installation according to claim 35, comprising means connected to said means for determining the $O_2$ content of the flue gas, to said means for determining the CO content of the flue gas, to said means providing a set point representing the sintering temperature, and to said means for measuring the exhaust gas temperature, and responsive to the operation thereof to form a signal indicating the temperature level of the process.

42. In a rotary furnace installation according to claim 35, comprising:
regulating means responsive to the characteristic value signal to regulate the settings of the blower, the furnace drive mechanism, and the fuel flow regulator by producing and feeding corresponding setting signals thereto; and
means for limiting the setting signals.

43. In a calcincing process which utilizes a rotary furnace installation of the type which receives pulverized raw material and exhaust flue gases through a cyclone heat exchanger by way of a blower connected to an inlet chamber of the furnace through which the raw material is received, which has a fuel burning system including a fuel flow regulator, which includes an outlet end feeding a cooler, and in which the furnace is rotated by a drive mechanism and is fed raw material by a feed mechanism, the improvement therein comprising the steps of:
measuring the exergy of each stream of heat produced directly or indirectly by the combustion gases;
combining the exergies of the streams of heat to obtain the exergy of the system as the sum of all of the exergies
sensing a plurality of operating parameters for the cooler, the rotary furnace and the heat exchanger which would result in a change in individual exergies; and
varying at least one of the operating parameters of quantity of fuel feed, speed of furnace rotation, quantity of exhaust gas flow and quantity of raw material feed in response to detection of a change in an operating parameter which would change an individual exergy, while maintaining the total system exergy constant.

44. The improved process as set forth in claim 43, and further comprising the steps of:
measuring the free residual lime content of the clinker; and
modifying the total exergy control in accordance with the free residual lime content of the clinker.

45. In a calcincing process which utilizes a rotary furnace installation of the type which receives pulverized raw material and exhaust flue gases through a heat exchanger by way of a blower connected to an inlet chamber of the furnace through which the raw material is received, which has a fuel burning system including a fuel flow regulator, which includes an outlet end feeding a cooler, and in which the furnace is rotated by a drive mechanism and is fed raw material by a feed mechanism, the improvement therein comprising the steps of:
calculating a model from the available heat introduced into the installation including that derived from the fuel, the exhaust gases and the raw material;
storing the model in a computer and calculating an exergy index from the heat components of the model;
measuring the actual exergy of each stream of heat produced directly or indirectly by combustion in the installation;
combining the actual exergies of the streams of heat to obtain an actual exergy index of the system as the sum of all the actual exergies;
comparing the actual exergies with the exergy components of the model to forecast a trend of the change of the individual actual exergies; and
varying at least one of the operating parameters of quantity of fuel feed, the quantity of exhaust gas flow and the quantity of raw material feed when the actual exergy index is outside predetermined limits of the calculated index to compensate for the forecasted trend.

* * * * *